US008004376B2

(12) United States Patent
Maloney et al.

(10) Patent No.: US 8,004,376 B2
(45) Date of Patent: Aug. 23, 2011

(54) ELECTRICAL SWITCHING APPARATUS AND SHUNT SEPARATOR THEREFOR

(75) Inventors: James Gerard Maloney, Industry, PA (US); Luis Enrique Betances Sansur, Santo Domingo (DO)

(73) Assignee: Eaton Corporation, Cleveland, OH (US)

( * ) Notice: Subject to any disclaimer, the term of this patent is extended or adjusted under 35 U.S.C. 154(b) by 475 days.

(21) Appl. No.: 12/333,629

(22) Filed: Dec. 12, 2008

(65) Prior Publication Data

US 2010/0148893 A1 Jun. 17, 2010

(51) Int. Cl.

| | |
|---|---|
| ***H01H 75/00*** | (2006.01) |
| ***H01H 77/00*** | (2006.01) |
| ***H01H 83/00*** | (2006.01) |
| ***H01H 81/00*** | (2006.01) |

(52) U.S. Cl. ..... 335/6; 335/16; 335/23; 335/24; 335/25; 335/35; 335/36; 335/37; 335/38; 335/39; 335/40; 335/41; 335/42; 335/43; 335/165; 335/167; 335/172; 337/6

(58) Field of Classification Search ..... 335/6, 16, 335/23–25, 35–43, 147, 195, 165–176; 337/6
See application file for complete search history.

(56) References Cited

U.S. PATENT DOCUMENTS

| | | | | |
|---|---|---|---|---|
| 2,679,565 | A * | 5/1954 | Ericson | 337/78 |
| 3,480,890 | A * | 11/1969 | Dunham et al. | 335/23 |
| 3,796,980 | A * | 3/1974 | Ellsworth | 337/6 |
| 5,341,191 | A | 8/1994 | Crookston et al. | |
| 5,565,827 | A * | 10/1996 | Gula et al. | 335/16 |
| 5,870,008 | A * | 2/1999 | Pannenborg et al. | 335/35 |
| 6,489,867 | B1 | 12/2002 | Turner et al. | |
| 6,801,110 | B2 | 10/2004 | Kolberg et al. | |

* cited by examiner

*Primary Examiner* — Anh Mai
*Assistant Examiner* — Mohamad Musleh
(74) *Attorney, Agent, or Firm* — Martin J. Moran

(57) ABSTRACT

A shunt separator is provided for an electrical switching apparatus including a housing, separable contacts enclosed within the housing, an operating assembly including a trip bar, and a trip assembly. The trip assembly cooperates with the trip bar to trip open the separable contacts in response to a fault condition. The trip assembly includes a number of shunts. The shunt separator includes a molded projection, which extends outwardly from the housing of the electrical switching apparatus. The molded projection at least partially surrounds a portion of the trip bar, thereby separating the number of shunts from the trip bar.

20 Claims, 4 Drawing Sheets

ELECTRICAL SWITCHING APPARATUS AND SHUNT SEPARATOR THEREFOR

BACKGROUND

1. Field

The disclosed concept relates generally to electrical switching apparatus and, more particularly, to electrical switching apparatus such as, for example, circuit breakers. The disclosed concept also relates to shunt separators for electrical switching apparatus.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism which opens separable contacts to interrupt the flow of current through the conductors of an electrical system in response to such fault conditions.

The separable contacts generally include a movable contact, which is disposed on a movable contact arm or finger, and a corresponding stationary contact. The movable contact arm is pivotable to move the movable contact into and out of electrical contact with the corresponding stationary contact. For example, the circuit breaker includes an operating assembly having a trip bar. The operating assembly cooperates with the movable contact arm to trip open the separable contacts in response to a fault condition.

The circuit breaker also includes a trip assembly having a load conductor and a plurality of flexible conductors (e.g., without limitation, wires; braids; cables), commonly referred to as shunts. The shunts electrically connect the movable contact arm and the load conductor. More specifically, each shunt is electrically coupled at one end to the load conductor, and at the other end to the movable contact arm. Typically, there are two shunts for each movable contact arm, with each shunt extending past a corresponding portion of the trip bar and being electrically connected to a corresponding end of the movable contact arm. The shunts are flexible to accommodate the motion of the movable contact arm during a fault condition. However, during short circuit fault conditions, for example, magnetic forces cause the two flexible shunts to attract one another. As a result, the shunts move and have a tendency to compress against the corresponding portion of the trip bar. Additionally, an arc, which results from the short circuit, generates debris and particulate matter that can accumulate on the trip bar and/or shunts. These occurrences undesirably inhibit operation (e.g., pivoting) of the trip bar and, therefore, can cause or contribute to adverse interrupting performance (e.g., without limitation, a no latch condition) of the circuit breaker.

There is, therefore, room for improvement in electrical switching apparatus such as, for example, circuit breakers and in shunt separators therefor.

SUMMARY

These needs and others are met by embodiments of the disclosed concept, which are directed to a shunt separator for an electrical switching apparatus such as, for example, a circuit breaker, wherein the shunt separator is structured to resist a number of shunts from undesirably engaging the trip bar of the circuit breaker.

As one aspect of the disclosed concept, a shunt separator is provided for an electrical switching apparatus. The electrical switching apparatus comprises a housing, separable contacts enclosed within the housing, an operating assembly including a trip bar, and a trip assembly structured to cooperate with the trip bar to trip open the separable contacts in response to a fault condition. The trip assembly includes a number of shunts. The shunt separator comprises: a molded projection structured to extend outwardly from the housing of the electrical switching apparatus, the molded projection being structured to at least partially surround a portion of the trip bar thereby separating the number of shunts from the trip bar.

As another aspect of the disclosed concept, an electrical switching apparatus comprises: a housing including a base; separable contacts enclosed within the housing; an operating assembly including a trip bar; a trip assembly being cooperable with the trip bar to trip open the separable contacts in response to a fault condition, the trip assembly including a number of shunts; and at least one shunt separator comprising: a molded projection extending outwardly from the base, the molded projection at least partially surrounding a portion of the trip bar, thereby separating the number of shunts from the trip bar.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
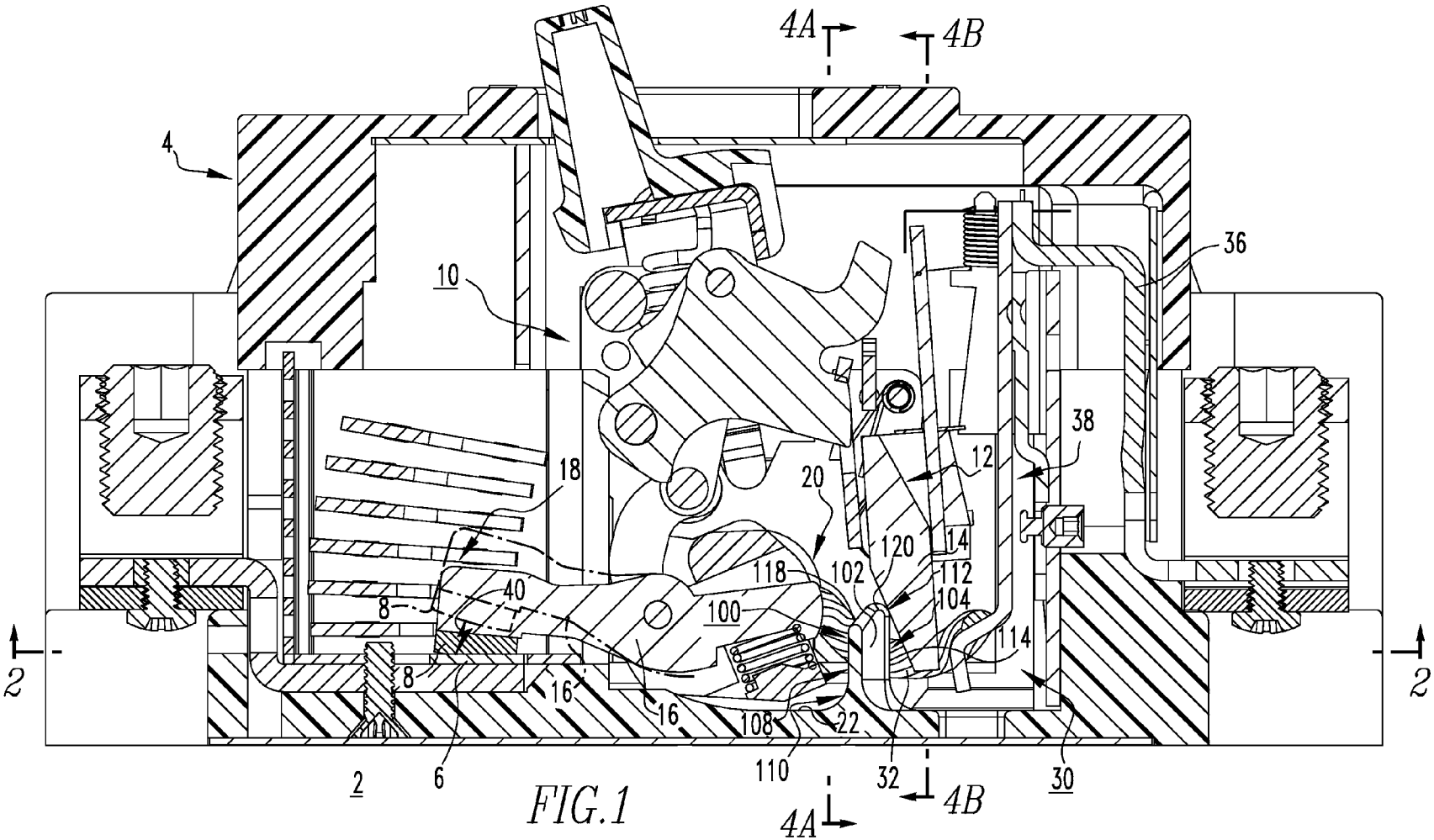
FIG. 1 is a section view of a circuit breaker and shunt separator therefor, in accordance with an embodiment of the disclosed concept.

Directional phrases used herein, such as, for example, top, bottom, front, back, left, right, upper, lower and derivatives thereof, relate to the orientation of the elements shown in the drawings and are not limiting upon the claims unless expressly recited therein.

As employed herein, the term "fault condition" refers to any abnormal electrical condition which could cause a circuit breaker to trip expressly including, without limitation, an overcurrent condition, an overload condition, an undervoltage condition, a relatively high level short circuit, a ground fault condition or an arc fault condition.

As employed herein, the statement that two or more parts are "coupled" together shall mean that the parts are joined together either directly or joined through one or more intermediate parts.

As employed herein, the term "number" shall mean one or more than one (i.e., a plurality).

Figure 2:
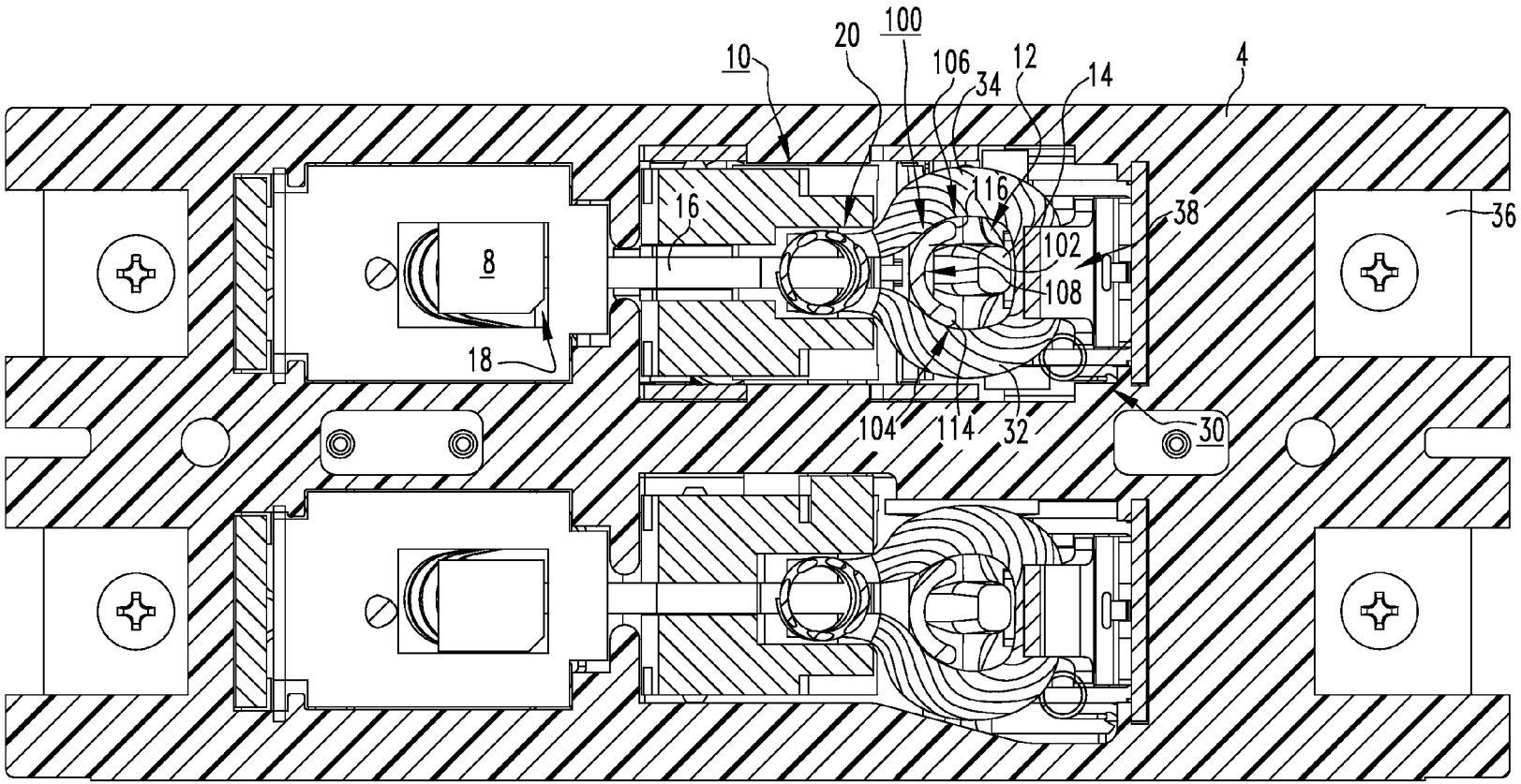
FIG. 2 is a section view taken along line 2-2 of FIG. 1.

FIGS. 1 and 2 show a shunt separator 100 for an electrical switching apparatus such as, for example, a circuit breaker 2. The circuit breaker 2 includes a housing 4, separable contacts 6,8 enclosed within the housing 4, an operating assembly (generally indicated by reference 10 in FIGS. 1 and 2) including a trip bar 12 (partially shown in FIG. 2), and a trip assembly 30. The trip assembly 30 is cooperable with the trip bar 12 to trip open (shown in phantom line drawing in FIG. 1) the separable contacts 6,8 in response to a fault condition. It will be appreciated that, although the circuit breaker 2 could have any known or suitable number of poles (two are shown in the example of FIG. 2) within the scope of the disclosed concept, with each pole having its own set of separable contacts 6,8 (both shown in FIG. 1) and a shunt separator 100, for economy of disclosure and ease of illustration, only one shunt separator 100 will be described in detail herein.

The separable contacts 6,8 of the example circuit breaker 2 include at least one stationary contact 6 and at least one movable contact 8 disposed on a movable contact arm 16. Each movable contact arm 16 has a first end 18, including a corresponding movable contact 8, and a second end 20, which is pivotably coupled within the circuit breaker housing 4. Specifically, the movable contact arm 16 is movable (e.g., pivotable) to move the movable contact 8 into (shown in solid line drawing in FIG. 1) and out of (shown in phantom line drawing in FIG. 1) electrical contact with a corresponding stationary contact 6.

As best shown in FIG. 1, the trip assembly 30 of the example circuit breaker 2 includes a load conductor 36, which is electrically connected to the movable contact arm 16 by way of a pair of conductive shunts 32,34 (both shown in FIG. 2). More specifically, the trip assembly 30 includes a bi-metal 38, which is disposed between the shunts 32,34 (both shown in FIG. 2) and the load conductor 36, with each shunt 32,34 being electrically connected at one end to the bi-metal 38, and at the other end to the end 20 of the corresponding movable contact arm 16. As will be described in greater detail hereinbelow, the shunt separator 100 is structured to be disposed between the first shunt 32 and the second shunt 34, as shown in FIG. 2.

Figure 3A:
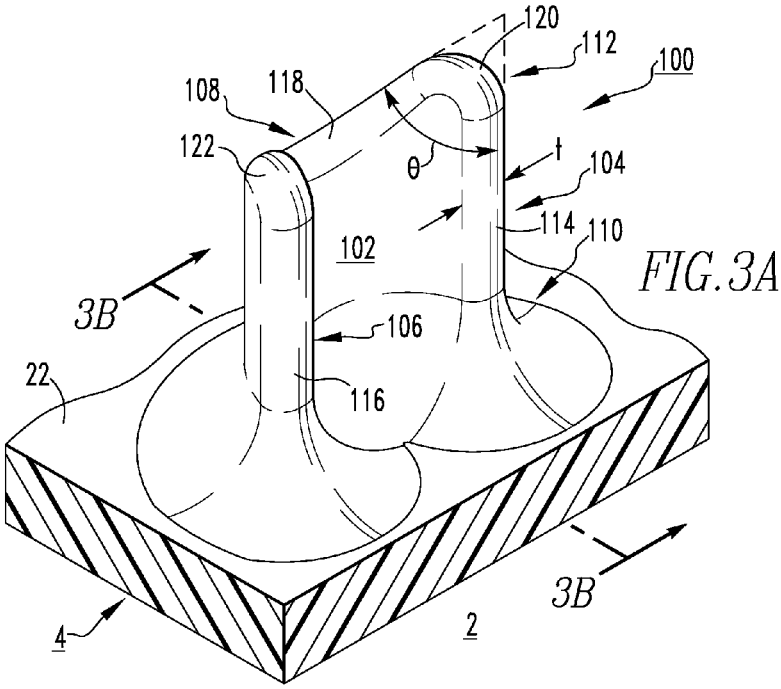
FIGS. 3A, 3B and 3C are isometric, section and top plan views, respectively, of the shunt separator of FIG. 2, with the section view of FIG. 3B being taken along line 3B-3B of FIG. 3A.
Figure 3B:
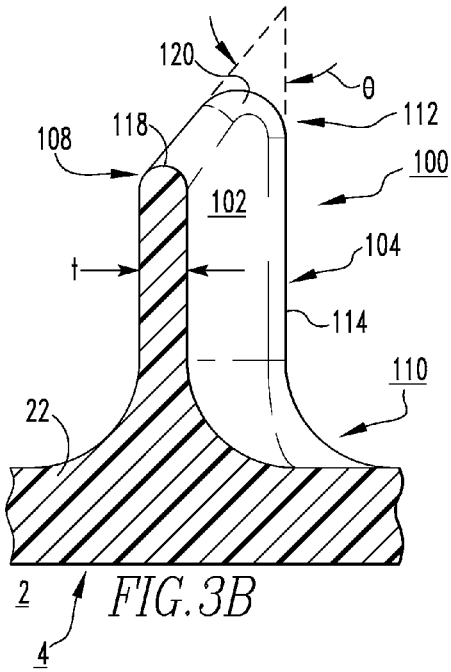
Figure 3C:
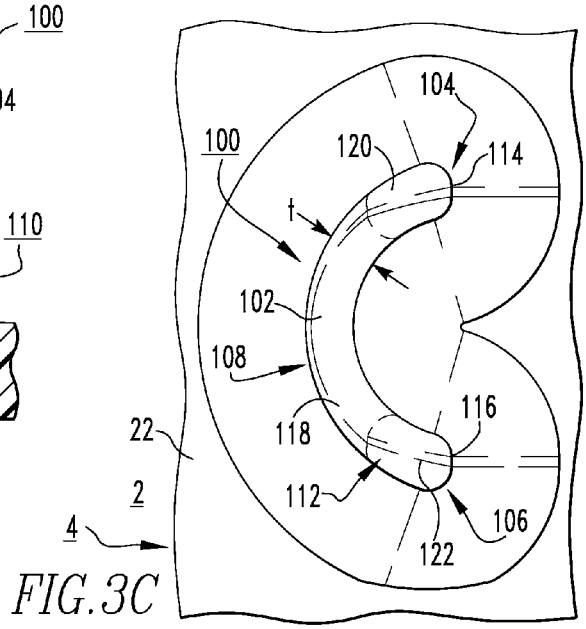
Figure 4A:
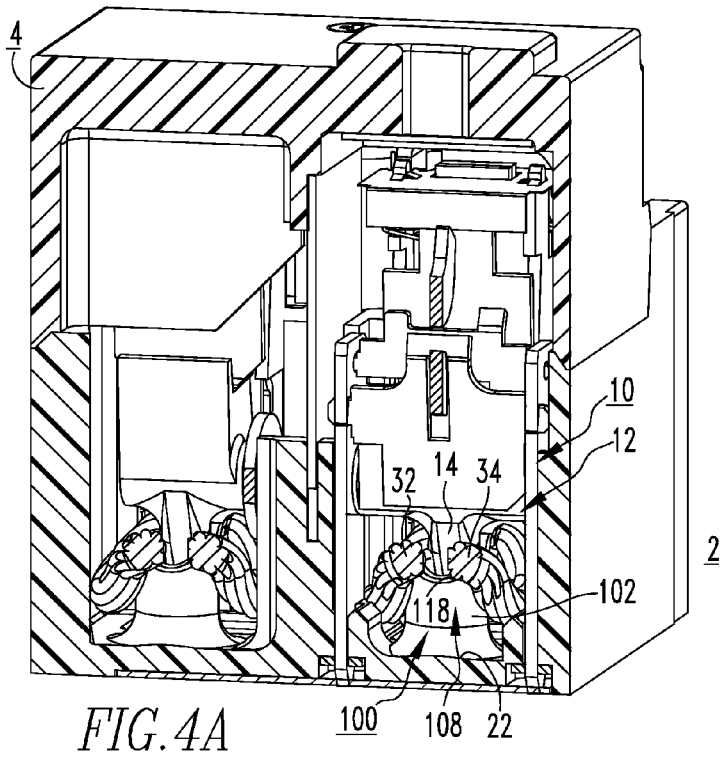
FIG. 4A is a section view taken along line 4A-4A of FIG. 1.

Continuing to refer to FIGS. 1 and 2, and also to FIGS. 3A-3C, the shunt separator 100 generally comprises a molded projection 102 extending outwardly from the circuit breaker housing 4. Preferably, the molded projection 102 extends perpendicularly outwardly from a base 22 of the circuit breaker housing 4, wherein the molded projection 102 and the base 22 are made from one single piece of material (e.g., without limitation, plastic), such that the shunt separator 100 is an integral portion of the circuit breaker housing 4 and, in particular, the base 22 thereof. The molded projection 102 is structured to at least partially surround a portion (e.g., a corresponding trip paddle 14) of the circuit breaker trip bar 12 to separate the shunts 32,34 therefrom, as shown in FIG. 2 (see also FIGS. 4A and 4B). Thus, as will be discussed, the molded projection 102 is structured to accommodate movement of the trip paddle 14 while separating the trip paddle 14 from the shunts 32,34. The molded projection 102 also shields the trip paddle 14 from debris (e.g., without limitation, particulate matter; molten metal), which can be generated as a by-product of the arc 40 (FIG. 1) that is formed in response to certain fault conditions. In this manner, the disclosed shunt separator 100 functions to ensure that neither such debris nor the shunts 32,34 will adversely interfere with the proper operation of the circuit breaker trip bar 12.

Figure 4B:
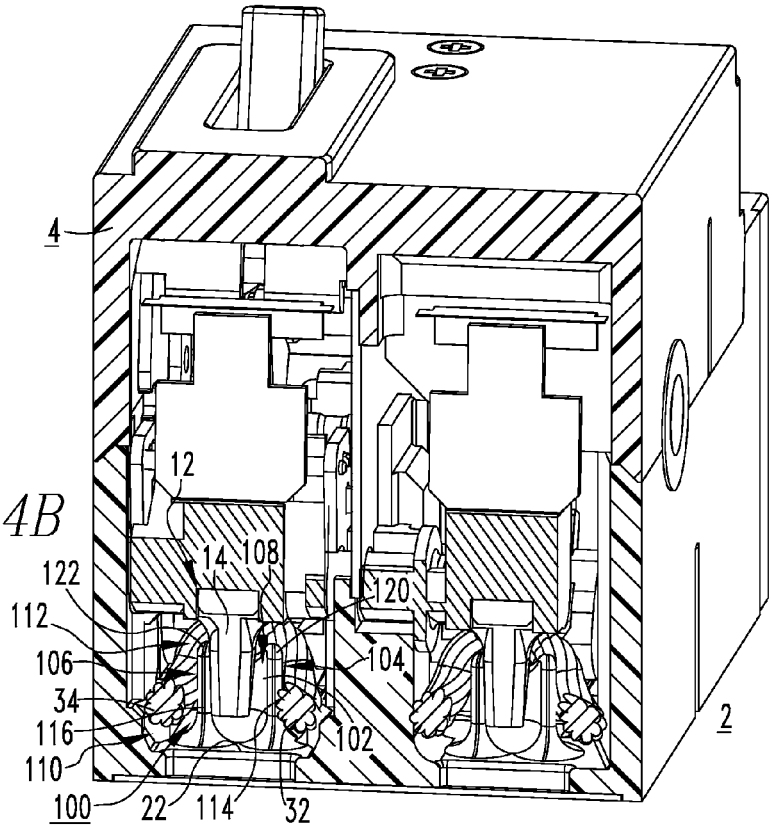
FIG. 4B is a sectional view taken along line 4B-4B of FIG. 1.

As shown in FIGS. 3A-3C, the molded projection 102 of the example shunt separator 100 includes a first side 104, a second side 106 (FIGS. 3A and 3C) disposed opposite and distal from the first side 104, and an intermediate portion 108 extending therebetween. The intermediate portion 108 at least partially surrounds (see, for example, FIG. 2) the trip paddle 14 of the trip bar 12 and, therefore, accommodates movement of the trip paddle 14 while separating it from the shunts 32,34 as previously described, and as shown in FIGS. 1, 2, 4A and 4B. More specifically, the intermediate portion 108 of the example shunt separator 100 has an arcuate shape such that, when it is viewed from a top plan prospective above the intermediate portion 108, it is generally C-shaped, as best shown in FIG. 3C. Thus, as shown in FIGS. 2 and 4B, the molded projection 102 is disposed between the first and second shunts 32,34, with the first side 104 of the molded projection 102 being disposed between the first shunt 32 and the trip paddle 14, and the second side 106 of the molded projection 102 being disposed between the second shunt 34 and the trip paddle 14. The intermediate portion 108 is, therefore, disposed between the trip paddle 14 and the separable contacts 6,8, as shown in FIG. 1.

The molded projection 102 of the example shunt separator 100 further includes a first end 110 disposed at or about the base 22 of the housing 4, a second end 112 disposed opposite and distal from the first end 110 (FIGS. 3A and 3B), a first edge 114 disposed at the first side 104 of the molded projection 102, a second edge 116 (FIGS. 3A and 3C) disposed at the second side 106 (FIGS. 3A and 3C) of the molded projection 102, and a third edge 118 disposed at the second end 112 of the molded projection 102. Each of the first, second and third edges 114,116,118 has a radius of curvature. In one non-limiting example, the radius of curvature of the first, second and third edges 114,116,118 is preferably about 0.02 inches to about 0.04 inches. As shown in FIGS. 3A and 3B, each of the first intersection 120 between the first side 104 and the second end 112 of the molded projection 102, and the second intersection 122 between the second side 106 and the second end 112 of the molded projection 102 also has a radius of curvature. Preferably the radius of curvature of such intersections 120,122 is about 0.05 inches to about 0.07 inches, although it will be appreciated that other radii of curvature could be employed for any or all of the features (e.g., without limitation, intermediate portion 108; edges 114,116,118; intersections 120,122), without departing from the scope of the disclosed concept. It will be appreciated that the radii of curvature provide the molded projection 102 of the shunt separator 100 with relatively smooth edges (e.g., 114,116, 118) (all shown in FIGS. 3A-3C) and intersections 120,122 (both shown in FIGS. 3A and 3C), which function to resist the shunts 32,34 (both shown in FIGS. 2, 4A and 4B) from undesirably catching or becoming stuck on the molded projection 102.

Continuing to refer to FIGS. 3A and 3B, it will be appreciated that the third edge 118 of the second end 112 of the molded projection 102 is disposed at an angle, θ, with respect to the first and second edges 114,116 of the first and second sides 104,106, respectively, of the molded projection 102. In one non-limiting example, the angle, θ, is preferably about 30 degrees to about 60 degrees. Such angle, θ, functions to further accommodate movement of the trip bar 12 and, in particular, the trip paddle 14 thereof, as shown in FIGS. 1, 2, 4A and 4B. The molded projection 102 of the shunt separator 100 also has a thickness, t, which in one non-limiting example is preferably about 0.05 inches to about 0.07 inches. In one non-limiting example, the aforementioned C-shaped of the intermediate portion 108 of the molded projection 102, which also functions to accommodate movement of the trip paddle 14 (FIGS. 1, 2, 4A and 4B), as well as to shield the trip paddle 14 from both the shunts 32,34 and/or debris, preferably has a radius of curvature of about 0.1 inches to about 0.2 inches.

Accordingly, the disclosed shunt separator 100 provides the molded projection 102, which is integral with the base 22 of the circuit breaker housing 4, and which effectively and efficiently shields the circuit breaker trip bar 12 from the shunts 32,34 and/or debris caused, for example, by an arc 40

(FIG. 1). In this manner, undesired interference with the operation of the trip bar by either the shunts 32,34 or such debris, is resisted.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A shunt separator for an electrical switching apparatus, said electrical switching apparatus comprising a housing, separable contacts enclosed within the housing, an operating assembly including a trip bar, and a trip assembly structured to cooperate with said trip bar to trip open said separable contacts in response to a fault condition, said trip assembly including a number of shunts, said shunt separator comprising:

a molded projection structured to extend outwardly from the housing of said electrical switching apparatus, said molded projection being structured to at least partially surround a portion of said trip bar thereby separating said number of shunts from said trip bar.

2. The shunt separator of claim 1 wherein, responsive to said fault condition, an arc is formed which generates debris; wherein said portion of said trip bar is a trip paddle extending outwardly from said trip bar; wherein said molded projection comprises a first side, a second side disposed opposite and distal from the first side, and an intermediate portion extending between the first side and the second side; wherein the intermediate portion is structured to accommodate movement of said trip paddle while separating said trip paddle from said number of shunts and shielding said trip paddle from said debris.

3. The shunt separator of claim 2 wherein said number of shunts is a first shunt and a second shunt; wherein said molded projection is structured to be disposed between said first shunt and said second shunt to separate said first shunt from said second shunt; wherein the first side of said molded projection is structured to be disposed between said first shunt and said trip paddle; wherein the second side of said molded projection is structured to be disposed between said second shunt and said trip paddle; and wherein the intermediate portion is structured to be disposed between said trip paddle and said separable contacts.

4. The shunt separator of claim 2 wherein the intermediate portion of said molded projection has an arcuate shape; and wherein the intermediate portion is generally C-shaped when viewed from above the intermediate portion.

5. The shunt separator of claim 2 wherein the housing of said electrical switching apparatus includes a base; wherein said molded projection further comprises a first end structured to be disposed at the base of the housing, a second end disposed opposite and distal from the first end, a first edge disposed at the first side of said molded projection, a second edge disposed at the second side of said molded projection, and a third edge disposed at the second end of said molded projection; and wherein each of the first edge, the second edge and the third edge has a radius of curvature.

6. The shunt separator of claim 5 wherein the radius of curvature of the first edge, the second edge and the third edge is about 0.02 inches to about 0.04 inches.

7. The shunt separator of claim 5 wherein the first side of said molded projection forms a first intersection with the second end of said molded projection; wherein the second side of said molded projection forms a second intersection with the second end of said molded projection; and wherein each of the first intersection and the second intersection has a radius of curvature of about 0.05 inches to about 0.07 inches.

8. The shunt separator of claim 5 wherein the third edge of the second end of said molded projection is disposed at an angle with respect to the first edge of the first side of said molded projection and the second edge of the second side of said molded projection; and wherein said angle is structured to accommodate movement of said trip bar of said electrical switching apparatus.

9. The shunt separator of claim 8 wherein said angle is about 30 degrees to about 60 degrees.

10. The shunt separator of claim 1 wherein the housing of said electrical switching apparatus includes a base; wherein said molded projection is structured to extend perpendicularly outwardly from the base; and wherein said molded projection and the base comprise one single piece of material.

11. An electrical switching apparatus comprising:

a housing including a base;

separable contacts enclosed within the housing;

an operating assembly including a trip bar;

a trip assembly being cooperable with said trip bar to trip open said separable contacts in response to a fault condition, said trip assembly including a number of shunts; and at least one shunt separator comprising:

a molded projection extending outwardly from the base, said molded projection at least partially surrounding a portion of said trip bar, thereby separating said number of shunts from said trip bar.

12. The electrical switching apparatus of claim 11 wherein, responsive to said fault condition, an arc is formed which generates debris; wherein said portion of said trip bar is a trip paddle extending outwardly from said trip bar; wherein said molded projection of said at least one shunt separator comprises a first side, a second side disposed opposite and distal from the first side, and an intermediate portion extending between the first side and the second side; wherein the intermediate portion accommodates movement of said trip paddle while separating said trip paddle from said number of shunts and shielding said trip paddle from said debris.

13. The electrical switching apparatus of claim 12 wherein said number of shunts is a first shunt and a second shunt; wherein said molded projection of said at least one shunt separator is disposed between said first shunt and said second shunt to separate said first shunt from said second shunt; wherein the first side of said molded projection is disposed between said first shunt and said trip paddle; wherein the second side of said molded projection is disposed between said second shunt and said trip paddle; and wherein the intermediate portion is disposed between said trip paddle and said separable contacts.

14. The electrical switching apparatus of claim 12 wherein the intermediate portion of said molded projection of said at least one shunt separator has an arcuate shape; and wherein the intermediate portion is generally C-shaped when viewed from above the intermediate portion.

15. The electrical switching apparatus of claim 12 wherein said molded projection of said at least one shunt separator further comprises a first end disposed at the base of the housing, a second end disposed opposite and distal from the first end, a first edge disposed at the first side of said molded projection, a second edge disposed at the second side of said molded projection, and a third edge disposed at the second end of said molded projection; and wherein each of the first edge, the second edge and the third edge has a radius of curvature.

16. The electrical switching apparatus of claim 15 wherein the radius of curvature of the first edge, the second edge and the third edge is about 0.02 inches to about 0.04 inches.

17. The electrical switching apparatus of claim 15 wherein the first side of said molded projection forms a first intersection with the second end of said molded projection; wherein the second side of said molded projection forms a second intersection with the second end of said molded projection; and wherein each of the first intersection and the second intersection has a radius of curvature of about 0.05 inches to about 0.07 inches.

18. The electrical switching apparatus of claim 15 wherein the third edge of the second end of said molded projection is disposed at an angle with respect to the first edge of the first side of said molded projection and the second edge of the second side of said molded projection; wherein said angle accommodates movement of said trip bar of said electrical switching apparatus; and wherein said angle is about 30 degrees to about 60 degrees.

19. The electrical switching apparatus of claim 11 wherein said molded projection of said at least one shunt separator extends perpendicularly outwardly from the base of the housing; and wherein said molded projection and the base comprise one single piece of material.

20. The electrical switching apparatus of claim 11 wherein said electrical switching apparatus is a circuit breaker; wherein said separable contacts of said circuit breaker include at least one stationary contact and at least one movable contact arm having a movable electrical contact; wherein said at least one movable contact arm is movable to move said movable electrical contact into and out of electrical contact with a corresponding one of said at least one stationary contact; wherein said trip assembly further comprises at least one load conductor; wherein said number of shunts is a pair of shunts for each of said at least one movable contact arm; wherein each of said pair of shunts electrically connects one of said at least one load conductor to a corresponding one of said at least one movable contact arm; and wherein said at least one shunt separator is one shunt separator for each of said pair of shunts.

* * * * *